United States Patent [19]

Ostrem et al.

[11] 4,055,134

[45] Oct. 25, 1977

[54] EDGE PROTECTION FOR EASY OPENING END CLOSURE

[75] Inventors: Obert M. Ostrem, Westmont; Donald F. Kulikowski, Oak Forest; Sam C. Pulciani, Norridge, all of Ill.

[73] Assignee: The Continental Group, Inc., New York, N.Y.

[21] Appl. No.: 712,409

[22] Filed: Aug. 5, 1976

Related U.S. Application Data

[60] Division of Ser. No. 657,418, Feb. 12, 1976, abandoned, which is a continuation-in-part of Ser. No. 641,472, Dec. 17, 1975, abandoned.

[51] Int. Cl.[2] ..... B21D 51/44

[52] U.S. Cl. ..... 113/121 C; 113/15 A; 220/90.6; 220/270; 220/276

[58] Field of Search ..... 113/15 A, 121 C; 220/90.6, 270, 276

[56] References Cited

U.S. PATENT DOCUMENTS

| | | | |
|---|---|---|---|
| 3,868,919 | 3/1975 | Schrecker et al. | 113/121 C |
| 3,894,652 | 7/1975 | Brown | 220/90.6 |
| 3,939,787 | 2/1976 | Morrison et al. | 113/121 C |
| 3,945,334 | 3/1976 | Ostrem et al. | 113/121 C |

*Primary Examiner*—Michael J. Keenan

*Attorney, Agent, or Firm*—John J. Kowalik; Joseph E. Kerwin; WilliamA. Dittmann

[57] ABSTRACT

An easy opening end closure is formed with annular, double folded band adjacent the chuck wall. A weakening line defining a removable panel portion is formed in the center segment of the fold so that the folded edges of the single band provide smooth protective surfaces on both the ledge and the removable panel portion.

This disclosure also relates to a method for forming the above described easy-opening end closure wherein the weakening line is formed in the end panel prior to complete formation of the folded band.

8 Claims, 8 Drawing Figures

EDGE PROTECTION FOR EASY OPENING END CLOSURE

This is a division Ser. No. 657,418, filed Feb. 12, 1976, now abandoned, which in turn is a Continuation-In-Part of Ser. No. 641,472 filed Dec. 17, 1975, also abandoned.

BACKGROUND OF THE INVENTION

This is a division of Ser. No. 657,418, filed Feb. 12, 1976, now abandoned, which in turn is a Continuation-In-Part of Ser. No. 641,472 filed Dec. 17, 1975, also abandoned.

The present invention relates to new and improved easy opening end closure of the full panel opening type and more particularly to the method of forming the same.

Full opening containers of the type to which the present invention relates include an end closure of which the end panel is formed with a weakening line located closely adjacent the chuck wall. The weakening line is formed by scoring and defines a removable panel section to which there is attached a pull tab. The pull tab is mounted so that upon initial lifting thereof the nose of the tab ruptures the weakening line to initiate the severance of the removable panel section from the end panel. Thereafter, the pull tab is pulled upwardly so that the remainder of the weakening line is ruptured and the removable panel section separated from the remainder of the panel substantially in the form of a disc.

The opening thus formed in the end closure is bounded by a horizontal ledge which terminates in a sharp raw edge caused by the severance of the removable panel portion therefrom. This sharp edge presents a hazard.

The edge on the removable portion is also sharp.

Folded end panels for edge protection are known in the art as, for example, Holk, U.S. Pat. No. 3,848,557. However, in the prior art, a fold band protects a single edge only and two bands are required to protect the edges of both the ledge and the removable panel. The requirement of two fold bands complicates the production process and increases the probability of rejection of the closure due to accidental fracture of the score line during fabrication.

SUMMARY OF THE INVENTION

By the present invention, it is proposed to provide a full opening easy-open end closure constructed and arranged so that the raw edges about the horizontal ledge and the removable panel are protected after severance of the removable panel portion.

This is accomplished generally by an end closure having an annular, single double folded band formed in the end panel adjacent the end closure chuck wall and in which a weakening line is formed in the center segment of the fold, so that the folded edges of the band provide smooth surfaces which bound the opening and the removable flap after separation.

It is another object to provide a new and novel method for forming a full opening easy-open end closure constructed in the manner specified in the foregoing object.

This is accomplished by forming the annular folded band in stages and the weakening line is formed by scoring prior to the final fold steps.

With the above and other objects in view that will hereinafter appear, the nature of the invention will be more readily understood by reference to the following description, the appended claims and the several views illustrated in the accompanying drawings.

DESCRIPTION OF THE PREFERRED EMBODIMENT

In accordance with the present invention, there is provided an easy-open end closure comprising an end panel 1 and a pull tab 2.

Figure 5:
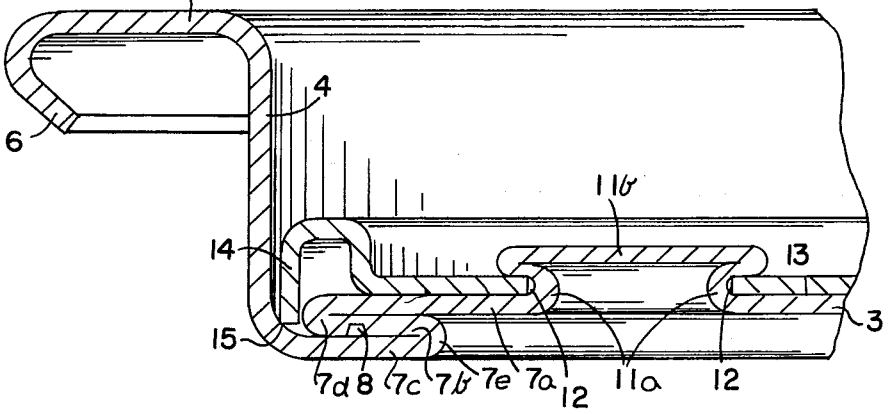
FIG. 5 is a fragmentary cross-sectional view taken substantially along line 4—4 of FIG. 1.
Figure 6:
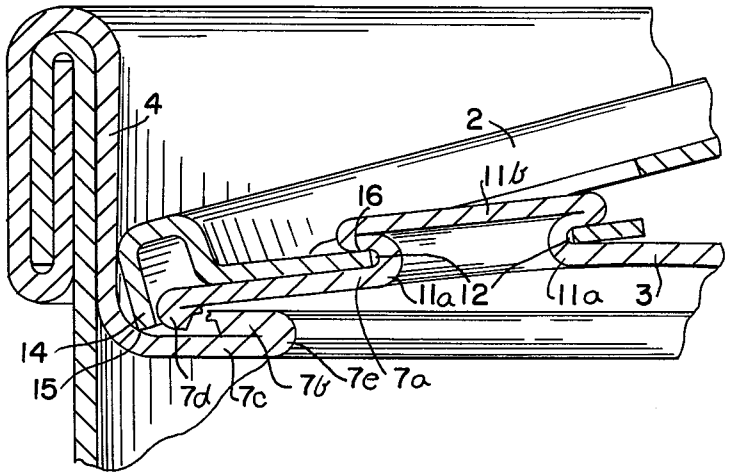
FIG. 6 is a fragmentary cross-sectional view similar to FIG. 5, illustrating the tab being lifted to open the closure.

The end panel 1 includes a substantially horizontally extending central panel 3 having at its periphery a chuck wall 4 which terminates in a horizontal flange 5 and a curled end 6. The central panel 3 is formed with an annular, double-folded band 7, radially inward of the chuck wall 4. As best seen in FIG. 5, the band 7 comprises substantially planar upper, intermediate and lower segments *7a, 7b* and *7c* respectively and curved segments *7d* and *7e,* the curved segments *7d* and *7e* connecting the planar segments *7a, 7b* and *7c* in an S-shaped series with the planar segments being substantially parallel and in close contact. A score line 8 is formed in the intermediate segment *7b,* in the side thereof toward the lower segment *7c,* and encircles an opening flap 9. The portion of the central panel 3 radially outward of the score line 8 is commonly referred to as the ledge, while the portion radially inward thereof is known as the removable panel portion or closure portion.

The pull tab 2 is longitudinally rigid and comprises a nose portion, an intermediate portion and a lift portion *2a, 2b* and *2c* respectively. The tab 2 is attached to the end panel 1 by a rivet 11, integrally formed in the central panel 3 in the portion thereof radially inward of the score 8. The rivet shank 11*a* passes through an opening 12 in the intermediate portion *2b* with the rivet head 11*b* pressing against the upper surface of the tab 2. A horseshoe shaped slit 13 is formed in the intermediate portion *2b* encompassing the rivet 11 and opening toward the nose portion *2a.* The nose portion *2a* terminates in a substantially vertical end member 14 which engages the central panel 3 at a point 15 between the chuck wall 4 and the fold band 7.

To open the closure, the lift portion of the tab 2 is displaced vertically, causing the tab 2 to pivot about the point of contact 15 between the end member 14 and the central panel 3 and impressing a downward force on the lower segment 7c and intermediate segment 7b of the fold band 7. At the same, the intermediate portion 2b of the tab 2 is exerting an upward force on the rivet head 11b at the point 16 thereon nearest the end member 14. This upward force is communicated to the upper segment 7a of the fold 7 through the rivet shank 11a. The opposing forces thus placed on the intermediate segment 7b result in fracture of the score line 8 in the area immediately adjacent the end member 14. After fracture has been initiated, the tab 2 is pulled away from the end panel 1 in the conventional manner to effect controlled tearing of the remainder of the score 8 and removal of the flap 9.

Figure 8:
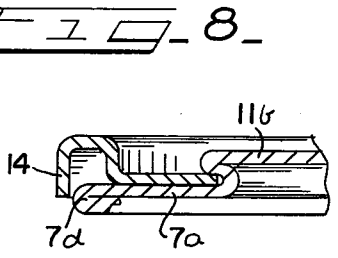
FIG. 8 is a fragmentary cross-sectional view illustrating the portion of the end closure removed from the container during opening.
Figure 7:
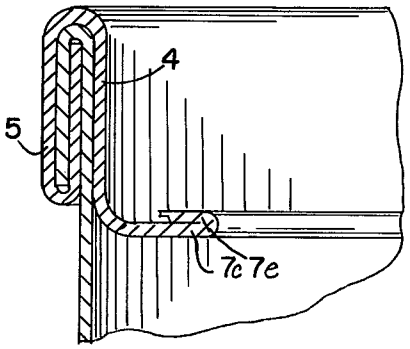
FIG. 7 is a fragmentary corss-sectional view illustrating the portion of the end closure attached to the container after opening.

As may be seen in FIGS. 7 and 8, the sharp edges created by the tearing of the score 8 are in shielded positions abutting the upper and lower segments 7a and 7b of the fold band 7. The flap 9 and the periphery of the opening in the central panel 3 present the harmless turned smooth surfaces of the curved segments, 7d and 7e respectively, to the user and others coming into contact with the closure.

Figure 1:
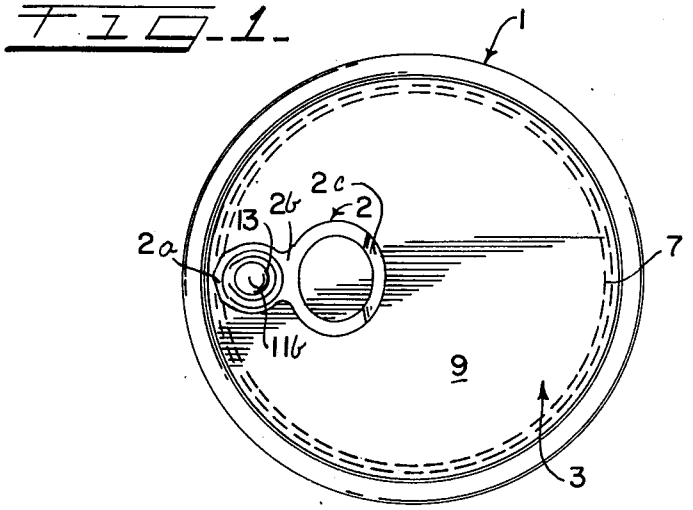
FIG. 1 is a top plan view of a full opening easy-open end closure incorporating the easy opening structure of the present invention.
Figure 2:
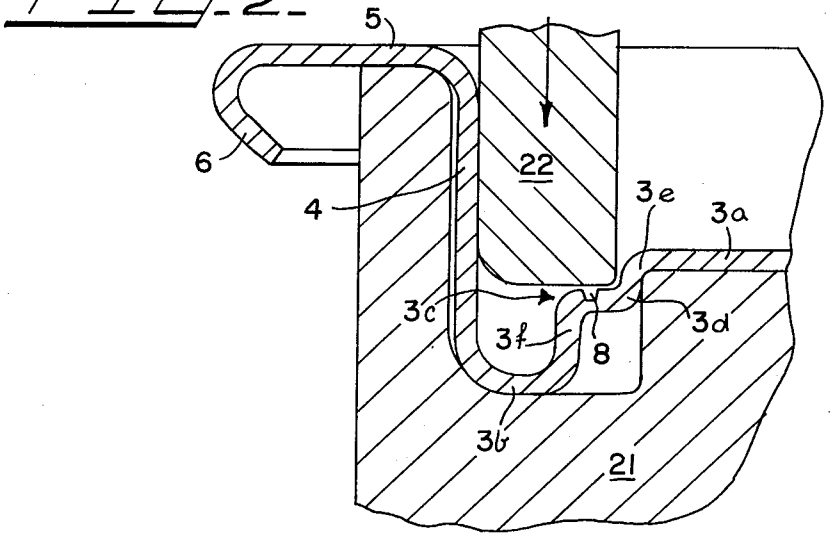
FIG. 2 is a fragmentary cross-sectional view of an end panel illustrating a step in the formation of the end closure of FIG. 1.

Referring to FIGS. 2, 3, 4 and 5 illustrating the stations for forming the end closure of the present invention, in FIG. 2 there is illustrated a first station for forming the same. In this station, the end panel 1 has already been formed with a chuck wall 4, flange 5 and curl 6 by means well known in the art. In addition, the center of the central panel 3 has been upset to form a transverse section 3a axially spaced from the remaining section 3b of the panel 3, the two sections 3b and 3b being joined by a connecting portion 3c having formed therein a score line 8. Although it is preferred that the connecting portion 3c be formed as a substantially horizontal ledge 3d and two substantially vertical members 3e and 3f, and that the score line 8 be located on the upper surface of the ledge 3d, it is to be understood that other connecting portion configurations and score locations therein are contemplated in the present invention. The end panel 1 rests on an anvil 21 which provides support for the flange 5 and chuck wall 4 and both sections 3a and 3b of the central panel 3. A punch 22 is provided which is configured to fit between the chuck wall 4 and the uppermost vertical member 3f of the connecting portion 3c.

Figure 3:
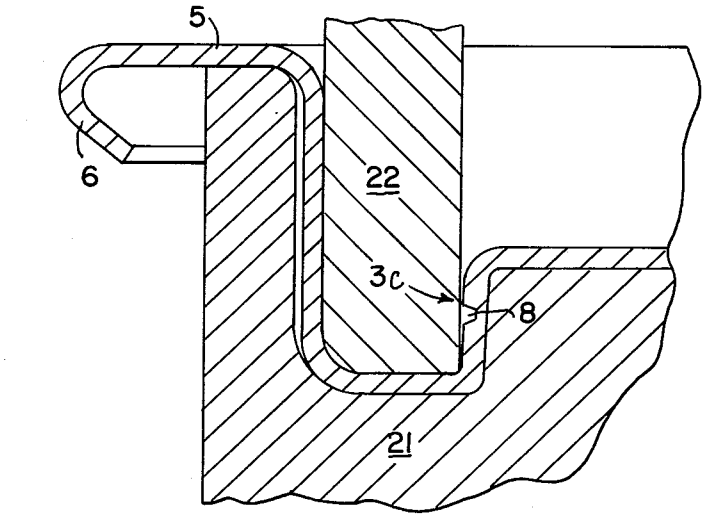
FIG. 3 is a fragmentary cross-sectional view similar to FIG.2, illustrating another formation step.

In FIG. 3, the punch 22 has been displaced vertically toward the anvil 21, thereby upsetting the connecting portion 3c such that the ledge 3d assumes a substantially vertical position. It is to be noted that the score line 8 is displaced radially inwardly during this operation. This reduction in the length of the score 8 results in the forces impressed thereon during the reformation being primarily compressive rather than tensile. This avoidance of tensile loading prevents score fracture during the forming process.

Figure 4:
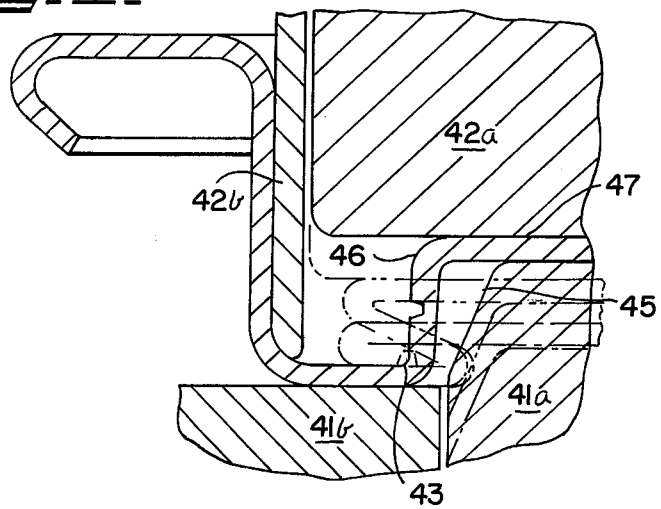
FIG. 4 is a fragmentary cross-sectional view similar to FIGS. 2 and 3, illustrating yet another formation step.

In the second forming station, illustrated in FIG. 4, there is provided a split anvil 41 and a split punch 42, each comprising a central movable portion 41a and 42a respectively and an outer fixed portion 41b and 42b respectively. The partially formed end closure from the first forming station is clampingly held between the fixed portions 41b and 42b of the punch 42 and the anvil 41. The movable portion 42a of the punch 42 is then displaced downwardly, causing a corresponding downward movement of the movable portion 41a of the anvil 41. As the punch portion 42a descends, the connecting portion 3c collapses, rotating outwardly and downwardly about a point 43 at the juncture of the connecting portion 3c and the lower portion 3b of the central panel 3. As the punch 42 descends, the upper end 46 of the connecting portion 3c is forced against the moving face 45 of the anvil 41. It is to be noted that the anvil face 45 slopes upwardly and inwardly, allowing point 43 to move radially inwardly during the rotation of the connecting portion 3c. Thus, the score line 8 is not substantially displaced radially, but is subjected to a primarily compressive loading during the reformation process. After the connecting portion 3c has been folded flat against the lower central panel portion 3b, the pull tab 2 is attached to the upper panel portion 3a with an integrally formed rivet 9 according to methods well known in the art.

We claim:

1. A method of producing an end closure for a can or similar container comprising the steps of: providing a shell having a generally flat end panel; forming in said end panel at least two axially offset sections joined by a connecting portion;

forming a score line in said connecting portion; upsetting said connecting portion so that at least a part thereof assumes a substantially perpendicular position relative to said two sections and part of it forms an extension of one of said sections, and then collapsing the remaining part of said connecting portion between said sections, said score being shifted radially inwardly during said upsetting of said connecting portion to effect a stress on the score residual primarily in compression.

2. The method of claim 1, wherein said connecting portion is formed to include a ledge substantially parallel to said two sections, and forming said score line in said ledge prior to collapsing said portion.

3. The method of claim 2, wherein said connecting portion is compressed, during said collapsing, between tools moving toward each other against opposite ends of said connecting portion.

4. The method of claim 3, wherein said tools provide opposing faces and the distance between said opposing faces decreases during collapsing movement of said connecting portion and said connecting portion swings in an arc about both ends.

5. A method of producing an end closure for a can or similar container, comprising the steps of:

forming a shell having an upstanding chuck wall about a panel;

drawing a portion of said panel into a substantially hat-shaped section having a portion transverse to said chuck wall and a connecting portion connecting said transverse portion and the remainder of said panel;

forming a score line in said connecting portion, with a predetermined score residual and then reforming said connecting portion to form a double-folded annular band about said transverse portion, said score line being displaced radially inwardly from its original position during said reforming of said connecting portion to effect a stress on said score residual primarily in compression.

6. The method of claim 5, wherein said reforming of said connecting portion comprises the steps of:

upsetting said connecting portion into a position whereat a portion thereof is substantially perpendicular to said transverse wall, and collapsing said perpendicular portion of said connecting portion whereby the same assumes a position substantially parallel to said panel.

7. A method of producing a container end closure comprising the steps of:

form a shell having an axially extending chuck wall about a panel;

drawing from a portion of said panel a section having a transverse portion, a connecting portion including radially offset portions, and an intervening ledge substantially parallel to the remaining portion of said panel and said transverse portion;

forming a score line in said ledge with a predetermined score residual;

upsetting said connecting portion to remove said ledge and dispose at least a portion of said connecting portion substantially perpendicular to said remaining portion of said panel and to said transverse portion, said upsetting of said connecting portion displacing said score line radially inwardly from its original position to stress the score residual primarily in compression; and displacing said transverse portion toward said remaining portion of said panel, thereby collapsing said perpendicular portion of said connecting portion between said remaining portion of said panel and said transverse portion.

8. A method of producing a container end closure comprising the steps of:

providing an end panel including at least two axially offset sections joined by a connecting portion;

forming a score line in said connecting portion with a predetermined score residual;

upsetting said connecting portion to a position substantially perpendicular to said axially offset portions, said score line being displaced radially inwardly during said upsetting to impress a compressive stress on the score residual; and advancing said sections toward each other, whereby said connecting portion is folded therebetween to form an annular S-shaped band.

* * * * *